US011143486B2

(12) United States Patent
Jones et al.

(10) Patent No.: US 11,143,486 B2
(45) Date of Patent: Oct. 12, 2021

(54) STOCK WITH MULTIPLE STRUCTURAL INSERTS

(71) Applicant: Daniel Defense, Inc., Black Creek, GA (US)

(72) Inventors: Larry Jones, Black Creek, GA (US); Marvin C. Daniel, Pooler, GA (US)

(73) Assignee: Daniel Defense, LLC, Black Creek, GA (US)

( * ) Notice: Subject to any disclaimer, the term of this patent is extended or adjusted under 35 U.S.C. 154(b) by 0 days.

(21) Appl. No.: 16/670,547

(22) Filed: Oct. 31, 2019

(65) Prior Publication Data

US 2020/0191521 A1 Jun. 18, 2020

Related U.S. Application Data

(60) Provisional application No. 62/778,715, filed on Dec. 12, 2018.

(51) Int. Cl.
*F41C 23/16* (2006.01)
*F41C 23/10* (2006.01)

(52) U.S. Cl.
CPC ..... *F41C 23/16* (2013.01); *F41C 23/10* (2013.01)

(58) Field of Classification Search
CPC ..... F41A 11/00; F41A 11/02; F41C 23/00; F41C 23/22; F41C 23/10; F41C 23/16; F41C 23/06; F41C 23/12
See application file for complete search history.

(56) References Cited

U.S. PATENT DOCUMENTS 1,063,061 A * 5/1913 Pickering ..... F41C 23/14 42/73
1,693,289 A * 11/1928 Warren ..... F41C 23/02 42/71.01
2,933,843 A * 4/1960 McFeeter ..... F41C 23/02 42/85
3,011,283 A * 12/1961 Lunn ..... F41C 23/00 42/71.01
3,206,885 A * 9/1965 Dye ..... F41C 23/00 42/75.03
3,208,180 A * 9/1965 Woodcock ..... F41C 23/08 42/74
3,263,359 A * 8/1966 Pachmayr ..... F41C 23/08 42/74
3,267,923 A * 8/1966 Ronci ..... F41C 23/10 124/84
3,371,442 A * 3/1968 Carlson ..... F41C 23/06 42/74
3,439,441 A * 4/1969 Lawley ..... F41C 23/00 42/75.01
3,512,290 A * 5/1970 La Violette, Jr. ..... F41A 3/66 42/75.01

(Continued)

*Primary Examiner* — Derrick R Morgan
(74) *Attorney, Agent, or Firm* — Merchant & Gould P.C.

(57) ABSTRACT

A firearm stock may be provided. The firearm stock may comprise a fore-end portion and a pistol grip portion. The fore-end portion may comprise a fore-end portion cavity and a fore-end insert. The fore-end insert may comprise a fore-end insert reinforcing structure disposed in the fore-end portion cavity. The pistol grip portion may comprise a pistol grip portion cavity and a pistol grip insert. The pistol grip insert may comprise a pistol grip insert reinforcing structure disposed in the pistol grip portion cavity.

15 Claims, 5 Drawing Sheets

(56) References Cited

U.S. PATENT DOCUMENTS 3,830,003 A * 8/1974 Clerke ..... F41C 23/00 42/75.03
4,328,633 A * 5/1982 Pachmayr ..... F41C 23/16 42/71.01
4,385,464 A * 5/1983 Casull ..... F41C 23/00 42/75.03
4,512,101 A * 4/1985 Waterman, Jr. ..... F41C 23/18 42/71.01
4,674,216 A * 6/1987 Ruger ..... F41C 23/18 42/71.01
5,149,899 A * 9/1992 Dabrowski ..... F41C 23/14 42/72
5,231,237 A * 7/1993 Cupp ..... F41C 23/10 42/71.02
5,465,520 A * 11/1995 Cupp ..... F41C 23/10 42/71.02
5,711,102 A * 1/1998 Plaster ..... F41C 23/00 42/71.01
7,954,270 B2 * 6/2011 Bentley ..... F41G 11/003 42/71.01
8,056,278 B2 * 11/2011 Bentley ..... F41A 21/10 42/75.02
8,782,940 B1 * 7/2014 Morris ..... F41A 11/02 42/69.01
9,074,839 B2 * 7/2015 Warburton ..... F41C 23/14
D744,055 S * 11/2015 Bitz ..... D22/108
9,322,611 B1 * 4/2016 Barfoot ..... F41A 21/48
9,429,387 B1 * 8/2016 Barfoot ..... F41C 23/20
10,247,512 B1 * 4/2019 Leslie ..... F41A 11/04
10,345,076 B2 * 7/2019 Fiester ..... F41C 27/00
2003/0136044 A1 * 7/2003 Williams ..... F41C 23/22 42/95
2005/0000140 A1 * 1/2005 Wikle ..... F41C 23/10 42/71.02
2007/0033850 A1 * 2/2007 Murello ..... F41C 23/16 42/71.01
2007/0175077 A1 * 8/2007 Laney ..... F41C 23/06 42/74
2009/0019757 A1 * 1/2009 Moretti ..... F41C 23/14 42/75.03
2010/0139144 A1 * 6/2010 Fitzpatrick ..... F41A 11/02 42/73
2010/0275490 A1 * 11/2010 Rotharmel ..... F41A 3/66 42/75.03
2011/0099872 A1 * 5/2011 Bentley ..... F41C 23/22 42/71.01
2013/0205635 A1 * 8/2013 Hines ..... F41C 23/16 42/71.02
2014/0250756 A1 * 9/2014 Vesligaj ..... F41C 23/06 42/74
2015/0285577 A1 * 10/2015 Faifer ..... F41C 23/04 42/94
2015/0338187 A1 * 11/2015 Priddy ..... F41C 23/22 42/71.01
2016/0010944 A1 * 1/2016 Downey ..... F41C 23/06 42/74
2016/0033231 A1 * 2/2016 Hall ..... F41C 7/11 42/51
2017/0153085 A1 * 6/2017 Thordsen ..... F41A 35/06
2017/0184364 A1 * 6/2017 Dewitt ..... F41A 19/46
2018/0017353 A1 * 1/2018 Lesenfants ..... F41C 23/06
2018/0112949 A1 * 4/2018 Joros ..... F41C 23/16
2018/0156555 A1 * 6/2018 Sessions ..... F41A 11/04
2018/0259293 A1 * 9/2018 Fiester ..... F41C 23/20
2018/0321012 A1 * 11/2018 Bentley ..... F41C 23/08
2019/0025008 A1 * 1/2019 Barnett ..... F41B 5/1426
2019/0063868 A1 * 2/2019 Rich ..... F41C 23/10
2019/0086168 A1 * 3/2019 Song ..... F41A 3/84
2020/0049450 A1 * 2/2020 Willits ..... F41A 3/66
2020/0158458 A1 * 5/2020 Faifer ..... F41C 23/04

* cited by examiner

STOCK WITH MULTIPLE STRUCTURAL INSERTS

RELATED APPLICATION

Under provisions of 35 U.S.C. § 119(e), Applicant claims the benefit of U.S. Provisional Application No. 62/778,715 filed Dec. 12, 2018, which is incorporated herein by reference.

BACKGROUND

A firearm stock, often simply a stock, also known as a shoulder stock, a buttstock, is a part of a long firearm such as a rifle, to which the barreled action and firing mechanism are attached thereto and is held against the user's shoulder when shooting the firearm. The stock provides a means for the shooter to firmly support the firearm and easily aim with stability. The stock also transmits recoil into the shooter's body.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
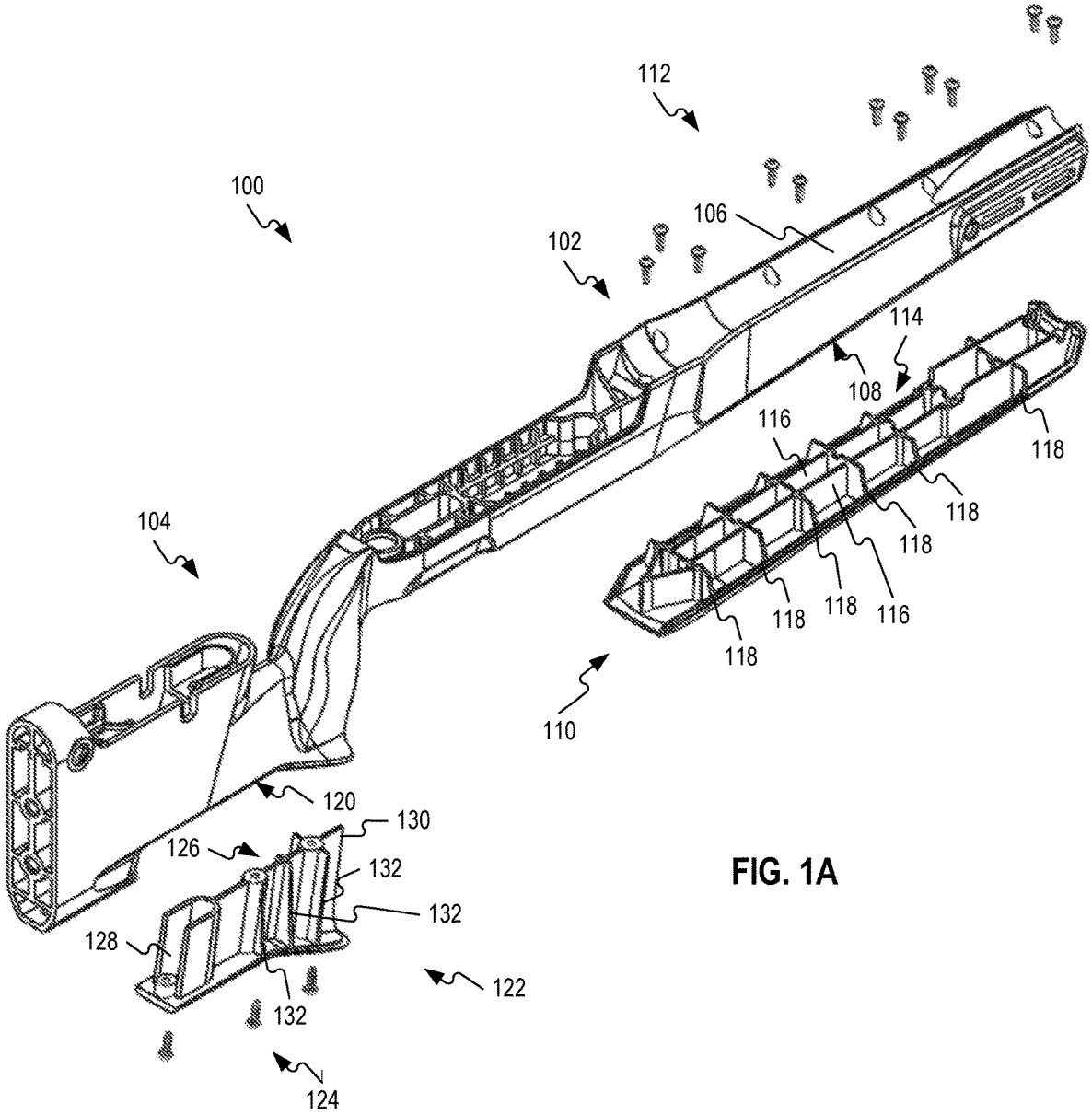
FIG. 1A shows a firearm stock with multiple structural inserts.

A firearm stock may be provided. The firearm stock may comprise a fore-end portion and a pistol grip portion. The fore-end portion may comprise a fore-end portion cavity and a fore-end insert. The fore-end insert may comprise a fore-end insert reinforcing structure disposed in the fore-end portion cavity. The pistol grip portion may comprise a pistol grip portion cavity and a pistol grip insert. The pistol grip insert may comprise a pistol grip insert reinforcing structure disposed in the pistol grip portion cavity.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

EXAMPLE EMBODIMENTS

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Firearm stocks may be manufactured using plastic molds. Creating plastic molds may be an expensive and time consuming process. To further complicate this, coring may be needed to prevent excessively thick heavy plastic walls. Consumers may desire strong lightweight stocks. In order to provide a strong lightweight stock, embodiments of the disclosure may comprise a fore-end portion and a pistol grip portion of a firearm stock that may comprise multiple parts. For example, a bottom of the fore-end portion may be bolted to the firearm stock using fasteners (e.g., 11 screws). Similarly, a bottom of the pistol grip portion may be bolted to the firearm stock using fasteners (e.g., 3 screws). Embodiments of the disclosure may allow for the fore-end portion and the pistol grip portion to be completely cored, making the firearm stock lighter than a solid fore-end portion and pistol grip portion design, but still stronger than a hollow fore-end portion and pistol grip portion design. Furthermore, embodiments of the disclosure may allow the fasteners (e.g., screws) at the fore-end portion to be inserted in a manner that allows them to be completely obscured by a barrel of a firearm that may be disposed on the firearm stock consistent with embodiments of the disclosure.

The firearm stock consistent with embodiments of the disclosure may be comprise several pieces. However, aspects of the disclosure may include how a fore-end insert and a pistol grip insert fit into the firearm stock. The firearm stock may be molded and cored, including the fore-end portion and pistol grip portion. The fore-end insert and the pistol grip insert may be molded and cored in a separate mold. The fore-end insert and pistol grip insert may then be placed into the firearm stock so that the fasteners (e.g., screws) may be threaded into firearm stock to clamp them together. Embodiments of the disclosure may provide a lightweight solution that may still maintain the strength of the firearm stock due to the coring.

Figure 1B:
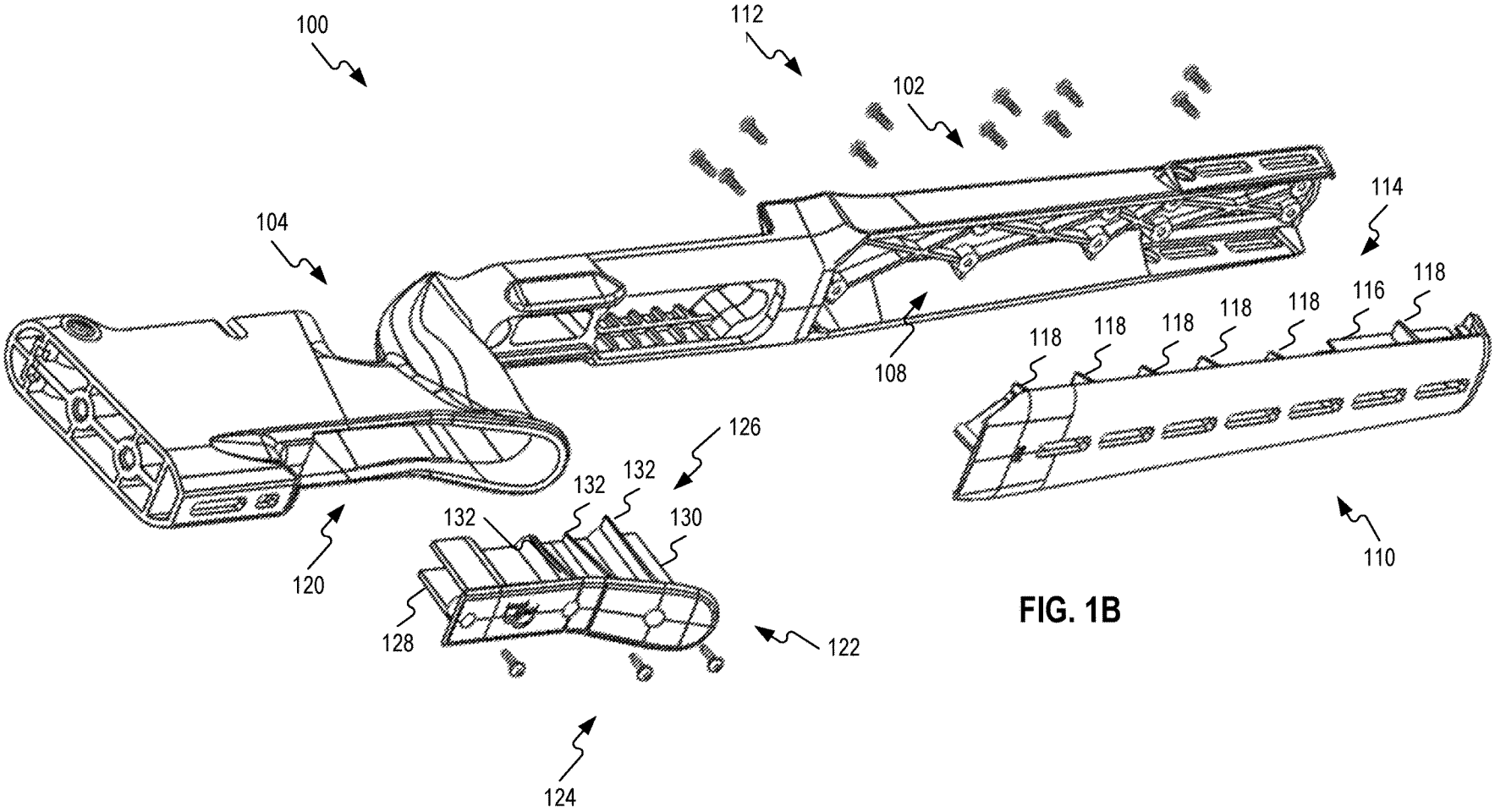
FIG. 1B shows a firearm stock with multiple structural inserts.
Figure 1C:
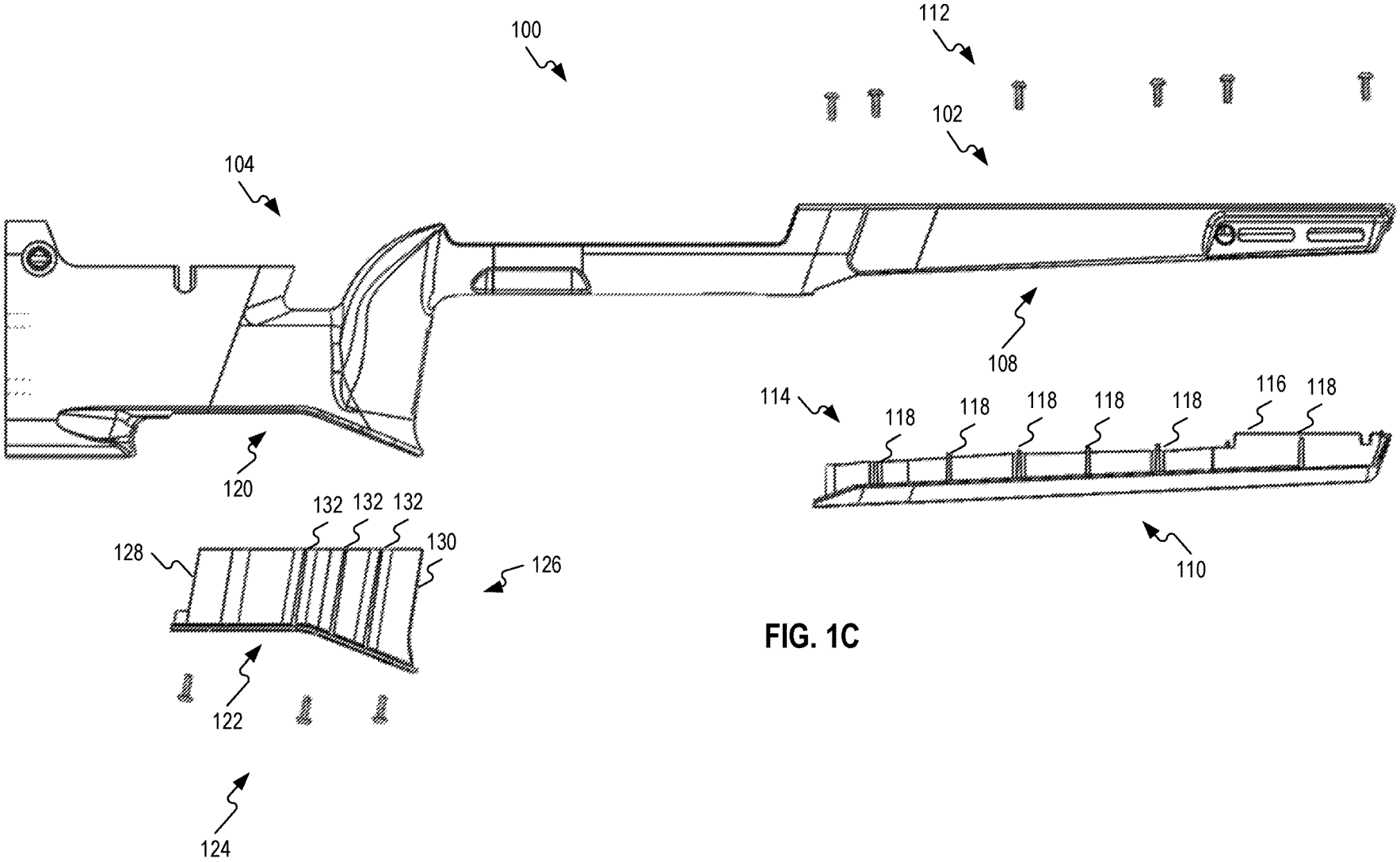
FIG. 1C shows a firearm stock with multiple structural inserts.

FIG. 1A, FIG. 1B, and FIG. 1C show a firearm stock 100 with multiple structural inserts. As shown in FIG. 1A, FIG. 1B, and FIG. 1C, firearm stock 100 may comprise a fore-end portion 102 and a pistol grip portion 104. Fore-end portion 102 may comprise a fore-end portion firearm barrel surface 106, a fore-end portion cavity 108, a fore-end insert 110, and a plurality of fore-end fasteners 112. Plurality of fore-end fasteners 112 may pass through corresponding holes in fore-end portion 102. Fore-end insert 110 may comprise a fore-end insert reinforcing structure 114. Fore-end insert reinforcing structure 114 may comprise a fore-end insert reinforcing structure plurality of longitudinal elements 116 and a fore-end insert reinforcing structure plurality of lateral elements 118.

Pistol grip portion 104 may comprise a pistol grip portion cavity 120, a pistol grip insert 122, and a plurality of pistol grip fasteners 124. Plurality of pistol grip fasteners 124 may pass through corresponding holes in pistol grip insert 122. Pistol grip insert 122 may comprise a pistol grip insert reinforcing structure 126. Pistol grip insert reinforcing structure 126 may comprise a pistol grip insert reinforcing structure rear element 128, a pistol grip insert reinforcing structure longitudinal element 130, and a pistol grip insert reinforcing structure plurality of lateral elements 132. Consistent with embodiments of the disclosure, the aforementioned multiple structural inserts may comprise fore-end insert 110 and pistol grip insert 122.

Consistent with embodiments of the disclosure, fore-end insert reinforcing structure 114 of fore-end insert 110 may be disposed in fore-end portion cavity 108. Plurality of fore-end fasteners 112 may be used to fasten fore-end insert 110 to fore-end portion 102 of firearm stock 100. Plurality of fore-end fasteners 112 may pass through fore-end portion firearm barrel surface 106 to attached to fore-end insert 110 and fastened fore-end insert 110 to fore-end portion 102. For example, plurality of fore-end fasteners 112 may attach to fore-end insert reinforcing structure 114. A firearm may be attached to firearm stock 100 and a barrel of the firearm may cover up or hide plurality of fore-end fasteners 112.

As stated above, fore-end insert reinforcing structure 114 may comprise fore-end insert reinforcing structure plurality of longitudinal elements 116 and fore-end insert reinforcing structure plurality of lateral elements 118. For example, fore-end insert reinforcing structure plurality of longitudinal elements 116 may intersect fore-end insert reinforcing structure plurality of lateral elements 118. Plurality of fore-end fasteners 112 may attach to fore-end insert reinforcing structure 114 at the intersections between fore-end insert reinforcing structure plurality of longitudinal elements 116 and fore-end insert reinforcing structure plurality of lateral elements 118.

Consistent with embodiments of the disclosure, ends of fore-end insert reinforcing structure plurality of lateral elements 118 may be adjacent to an interior surface of fore-end portion cavity 108. Spaces between fore-end insert reinforcing structure plurality of longitudinal elements 116 and fore-end insert reinforcing structure plurality of lateral elements 118 may allow some hollow spaces in fore-end portion 102. Consequently, fore-end insert reinforcing structure 114 may strengthen and add structure to fore-end portion 102 while also allowing fore-end portion 102 to be lighter than a solid fore-end portion 102 due to the aforementioned hollow spaces.

Consistent with embodiments of the disclosure, pistol grip insert reinforcing structure 126 of pistol grip insert 122 may be disposed in pistol grip portion cavity 120. Plurality of pistol grip fasteners 124 may be used to fasten pistol grip insert 122 to pistol grip portion 104 of firearm stock 100. Plurality of pistol grip fasteners 124 may pass through pistol grip insert 122 to attached to pistol grip portion 104. For example, plurality of pistol grip fasteners 124 may pass through pistol grip insert reinforcing structure 126.

As stated above, pistol grip insert reinforcing structure 126 may comprise pistol grip insert reinforcing structure rear element 128, pistol grip insert reinforcing structure longitudinal element 130, and pistol grip insert reinforcing structure plurality of lateral elements 132. For example, pistol grip insert reinforcing structure longitudinal element 130 may intersect pistol grip insert reinforcing structure plurality of lateral elements 132. Plurality of pistol grip fasteners 124 may attach pistol grip insert 122 to pistol grip portion 104 at the intersections between pistol grip insert reinforcing structure longitudinal element 130 and pistol grip insert reinforcing structure plurality of lateral elements 132.

Consistent with embodiments of the disclosure, ends of pistol grip insert reinforcing structure plurality of lateral elements 132 may be adjacent to an interior surface of pistol grip portion cavity 120. Pistol grip insert reinforcing structure rear element 128 may attach to pistol grip insert reinforcing structure longitudinal element 130. Pistol grip insert reinforcing structure rear element 128 may be U shaped and may comprise ends that may be adjacent to the interior surface of pistol grip portion cavity 120. Spaces between pistol grip insert reinforcing structure longitudinal element 130 and pistol grip insert reinforcing structure plurality of lateral elements 132 may allow some hollow spaces in pistol grip portion 104. Consequently, pistol grip insert reinforcing structure 126 may strengthen and add structure to pistol grip portion 104 while also allowing pistol grip portion 104 to be lighter than a solid pistol grip portion 104 due to the aforementioned hollow spaces.

Figures 2A, 2B:
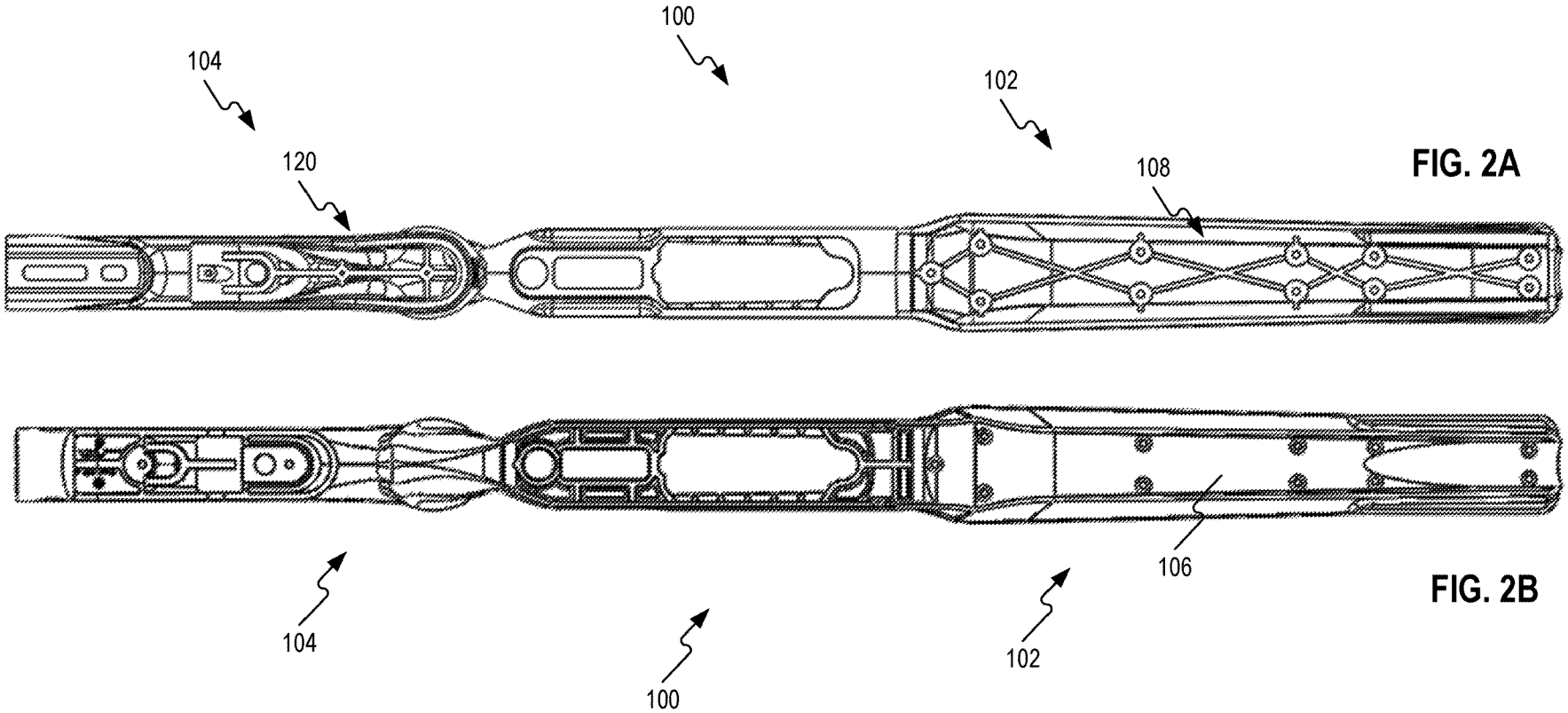
FIG. 2A shows a bottom view of a firearm stock with the multiple structural inserts removed.
FIG. 2B shows a top view of a firearm stock with the multiple structural inserts.

FIG. 2A shows a bottom view of firearm stock 100 with the multiple structural inserts removed. FIG. 2A illustrates fore-end portion 102 having fore-end portion cavity 108 and pistol grip portion 104 having pistol grip portion cavity 120. FIG. 2B shows a top view of firearm stock 100 with the multiple structural inserts. FIG. 2B illustrates fore-end portion 102 having fore-end portion firearm barrel surface 106 and pistol grip portion 104.

Figure 3A:
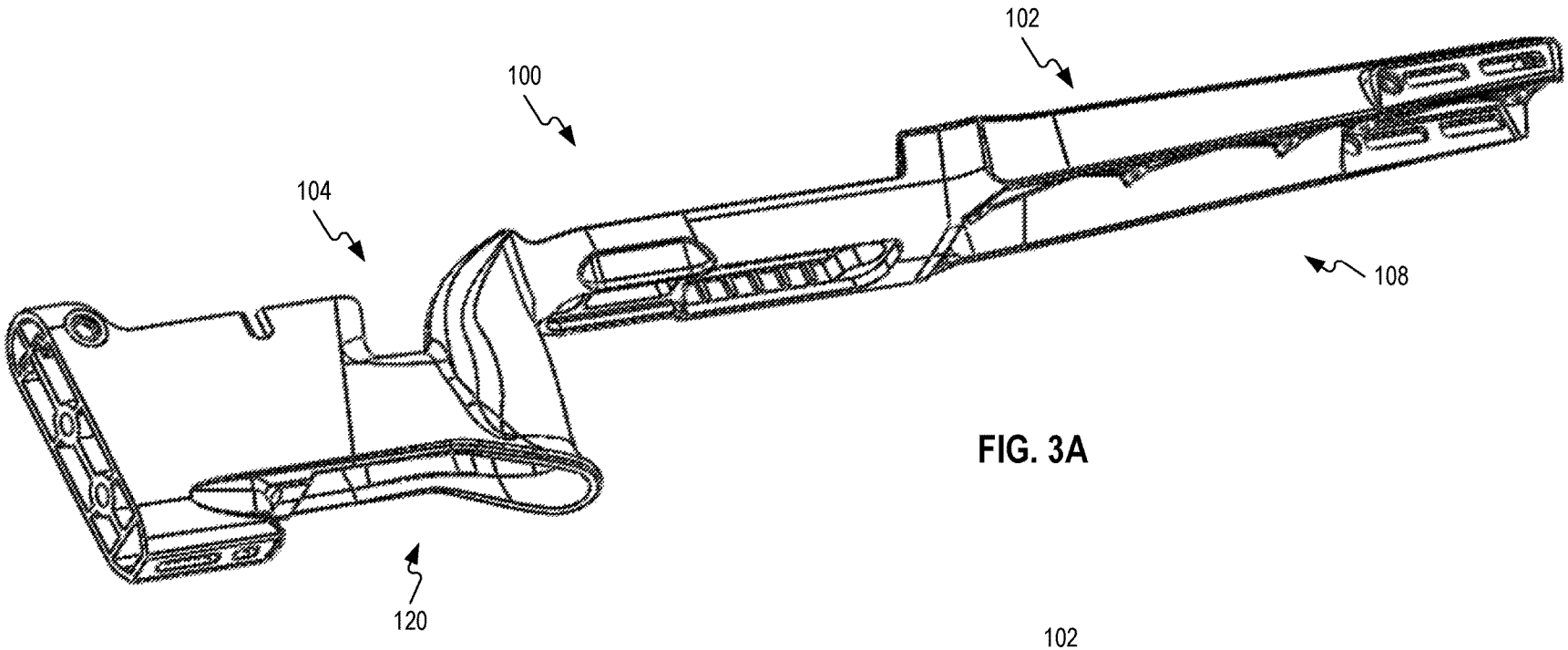
FIG. 3A shows a side view of a firearm stock with the multiple structural inserts removed.
Figure 3B:
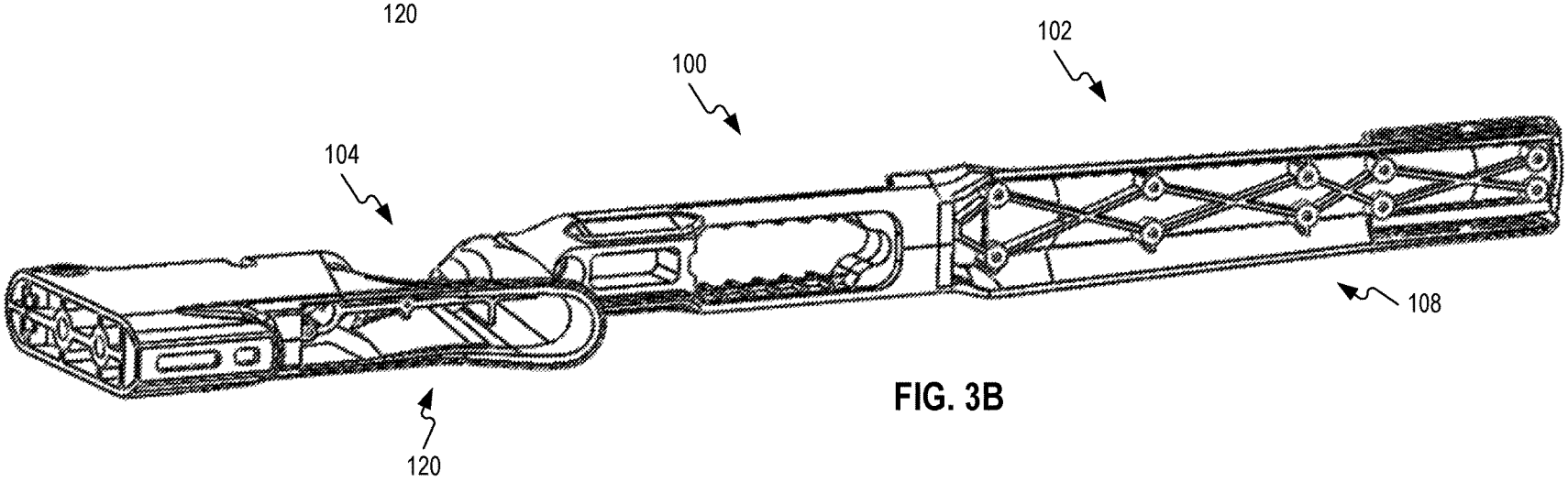
FIG. 3B shows a bottom view of a firearm stock with the multiple structural inserts removed.

FIG. 3A shows a side view of firearm stock 100 with the multiple structural inserts removed. FIG. 3A illustrates fore-end portion 102 having fore-end portion cavity 108 and pistol grip portion 104 having pistol grip portion cavity 120. FIG. 3B shows a bottom view of firearm stock 100 with the multiple structural inserts removed. FIG. 3B illustrates fore-end portion 102 having fore-end portion cavity 108 and pistol grip portion 104 having pistol grip portion cavity 120.

Consequently, embodiments of the disclosure may provide a lightweight firearm stock due to coring, a multiple piece design that may allow for coring, and a strong design that may be due to a rigid assembly method and a strong web design. Embodiments of the disclosure may provide many benefits. For example, embodiments may be strong and rigid part due to the coring. This may be especially true as compared to a completely hollow firearm stock. Furthermore, embodiments of the disclosure may provide a lighter firearm stock as compared to a solid plastic firearm stock and may not exhibit any sink due to different cooling rates of the thicker plastic.

Embodiments of the present disclosure, for example, are described above with reference to block diagrams and/or operational illustrations of methods and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. A firearm stock comprising:

a pistol grip portion having an opening in a bottom of the pistol grip portion;

wherein the pistol grip portion is positioned rearward of a firearm action receiving area of the firearm stock;

a pistol grip portion cavity having an interior surface; and a pistol grip insert comprising a pistol grip insert reinforcing structure disposed through the opening in the pistol grip portion cavity wherein the pistol grip insert reinforcing structure comprises;

a pistol grip insert reinforcing structure longitudinal element, and a pistol grip insert reinforcing structure rear element wherein the pistol grip insert reinforcing structure rear element is U shaped comprising ends that directly abut the interior surface of the pistol grip portion cavity.

2. The firearm stock of claim 1, further comprising at least one pistol grip fastener configured to fastened the pistol grip insert to the pistol grip portion.

3. The firearm stock of claim 2, wherein the at least one pistol grip fastener is attached to the pistol grip portion at an intersection of a pistol grip insert reinforcing structure longitudinal element and a pistol grip insert reinforcing structure lateral element of the pistol grip insert.

4. The firearm stock of claim 1, wherein the pistol grip insert reinforcing structure comprises a pistol grip insert reinforcing structure plurality of lateral elements.

5. The firearm stock of claim 4, wherein the pistol grip insert reinforcing structure longitudinal element intersect the pistol grip insert reinforcing structure plurality of lateral elements.

6. The firearm stock of claim 4, wherein ends of the pistol grip insert reinforcing structure plurality of lateral elements are adjacent to the interior surface of the pistol grip portion cavity.

7. The firearm stock of claim 1, wherein the pistol grip insert reinforcing structure rear element is attached to the pistol grip insert reinforcing structure longitudinal element.

8. A firearm stock comprising:

a fore-end portion comprising;

a bottom disposed fore-end portion cavity, and a bottom disposed fore-end insert comprising a fore-end insert reinforcing structure disposed in the bottom disposed fore-end portion cavity; and a pistol grip portion having an opening in a bottom of the pistol grip portion, the pistol grip portion comprising;

a pistol grip portion cavity having an interior surface, and a pistol grip insert comprising a pistol grip insert reinforcing structure disposed in the pistol grip portion cavity wherein the pistol grip insert reinforcing structure comprises;

a pistol grip insert reinforcing structure longitudinal element, and a pistol grip insert reinforcing structure rear element wherein the pistol grip insert reinforcing structure rear element is U shaped comprising ends that directly abut the interior surface of the pistol grip portion cavity.

9. The firearm stock of claim 8, further comprising:

a fore-end portion firearm barrel surface; and at least one fore-end fastener passing through the fore-end portion firearm barrel surface, the at least one fore-end fastener being attached to the bottom disposed fore-end insert and configured to fastened the bottom disposed fore-end insert to the fore-end portion.

10. The firearm stock of claim 8, further comprising at least one pistol grip fastener configured to fastened the pistol grip insert to the pistol grip portion.

11. The firearm stock of claim 10, wherein the at least one pistol grip fastener is attached to the pistol grip portion at an intersection of a pistol grip insert reinforcing structure longitudinal element and a pistol grip insert reinforcing structure lateral element of the pistol grip insert.

12. The firearm stock of claim 8, wherein the pistol grip insert reinforcing structure comprises a pistol grip insert reinforcing structure plurality of lateral elements.

13. The firearm stock of claim 12, wherein the pistol grip insert reinforcing structure longitudinal element intersect the pistol grip insert reinforcing structure plurality of lateral elements.

14. The firearm stock of claim 12, wherein ends of the pistol grip insert reinforcing structure plurality of lateral elements are adjacent to the interior surface of the pistol grip portion cavity.

15. The firearm stock of claim 8, wherein the pistol grip insert reinforcing structure rear element is attached to the pistol grip insert reinforcing structure longitudinal element.

* * * * *